United States Patent [19]

Knapp

[11] 4,423,811

[45] Jan. 3, 1984

[54] MOLDED CONTAINER

[75] Inventor: Jules F. Knapp, Highland Park, Ill.

[73] Assignee: United Coatings, Inc., Chicago, Ill.

[21] Appl. No.: 431,206

[22] Filed: Sep. 30, 1982

[51] Int. Cl.[3] ..... B65D 83/10

[52] U.S. Cl. ..... 206/362.3; 206/15.3; 206/470; 229/2.5 R

[58] Field of Search ..... 206/470, 361, 362.3, 206/15.2, 15.3; 229/2.5 R

[56] References Cited

U.S. PATENT DOCUMENTS

| | | | |
|---|---|---|---|
| 2,963,150 | 12/1960 | Dgetluck | 206/470 |
| 3,004,661 | 10/1961 | Schumann | 206/361 |
| 3,127,985 | 4/1964 | Scott | 206/362.3 |
| 3,463,309 | 8/1969 | Szostek | 206/470 |
| 3,746,162 | 7/1973 | Bridges | 206/361 |
| 4,016,972 | 4/1977 | Szamborski | 206/470 |
| 4,058,212 | 11/1977 | Wyslotsky | 206/470 |
| 4,319,684 | 3/1982 | Backman et al. | 206/470 |

*Primary Examiner*—Joseph Man-Fu Moy

*Attorney, Agent, or Firm*—Dressler, Goldsmith, Shore, Sutker & Milnamow, Ltd.

[57] ABSTRACT

A molded container for displaying an article comprises a pair of recessed panels that hingably close along a rib portion at the upper ends thereof to form a compartment and to define an opening at the lower end of the container in communication with the compartment through which a portion of the article displayed within the compartment can extend. The container also includes closure means for releasably securing the recessed panels in the closed position to hold the article therebetween.

4 Claims, 4 Drawing Figures

MOLDED CONTAINER

BACKGROUND OF THE INVENTION

The present invention relates to a molded container, and in particular, to a molded plastic container comprising two recessed panels that can be folded along a rib portion to form a compartment. Closure means is provided to maintain the container in the closed position and to hold an article within the compartment.

Many prior art containers include hingably connected sections adapted to confront each other to define a compartment for holding an article. Such containers are made by forming a heated sheet of thermoplastic material with a die that determines the three dimensional configuration of the container. Following the forming operation, the outline of the container is cut by a ruling die that leaves a continuous flange about the outer edge of the container. It is recognized that the ruling die must cut along a single plane, which means that the container must be designed so that the flanges initially lie in that plane.

If such a container comprises only two sections hinged together along a central folding line, the inner surfaces of those two sections can be folded to confront each other, and the sections can be secured together by closure means to maintain the container in the closed condition.

The present invention is directed primarily to containers for holding and displaying paint brushes, although any article can be held within such a container provided the proper forming die is used.

With reference to the prior art, the following U.S. patents—Ringler (U.S. Pat. No. 2,290,359); White (U.S. Pat. No. 2,506,821); First (U.S. Pat. No. 2,506,954); Ringler (U.S. Pat. No. 2,609,920) and Allen (U.S. Pat. No. 3,356,277)—relate to containers including foldable panels for wrapping brushes to maintain the proper contour of the bristles. Containers of that type are usually formed of paper and, although reusable, can be ripped easily if the paper becomes wet or if the panels are folded too often.

U.S. Pat. No. 3,800,998 to Gask, on the other hand, discloses a foldable molded container formed of plastic. In particular, see FIGS. 4 and 5 in which the object held within the container is a paint brush. The container is folded along flexible hinge lines at the lower end thereof, and a tab and slot assembly at the upper end of the container functions as a releasable closure means.

U.S. Pat. No. 3,400,873 to Bessett discloses a molded paper or plastic container foldable along hinge lines to accommodate an article. A conventional flap assembly holds the container in a closed configuration.

U.S. Pat. Nos. 3,356,277, 3,695,514 and 4,225,077 to Hohnjec, Mascetti, Jr. and Veitinger, respectively, relate to foldable molded containers that include peg and socket means at the upper end thereof for releasably closing the panels of the container.

SUMMARY OF THE INVENTION

A molded container for displaying an article comprises first and second recessed panels, each recessed panel including a flange about the perimeter thereof and having an upper end and a lower end, the panels being hingably connected to one another by a rib portion at their upper ends so that when the panels are moved to a closed position in which the inner surface of the first recessed panel contacts the inner surface of the second recessed panel, a compartment is formed between the recessed panels, a base section is formed at the lower end of the container, and an opening is defined in the base section through which a portion of the article displayed in the container can extend. The container also includes closure means comprising a first connecting member at the lower end of the first recessed panel and a second connecting member at the lower end of the second recessed panel whereby insertion of the first connecting member within the second connecting member releasably secures the recessed panels in the closed position to hold the article therebetween.

In another embodiment, a pair of first connecting members can be provided at both the upper and lower ends of the first recessed panel and a corresponding pair of second connecting members can be provided at both the upper and lower ends of the second recessed panel to releasably secure the article in the compartment formed between the recessed panels. In this manner, the recessed panels are releasably secured at four points, rather than at only two points.

DETAILED DESCRIPTION OF THE INVENTION

Figure 1:
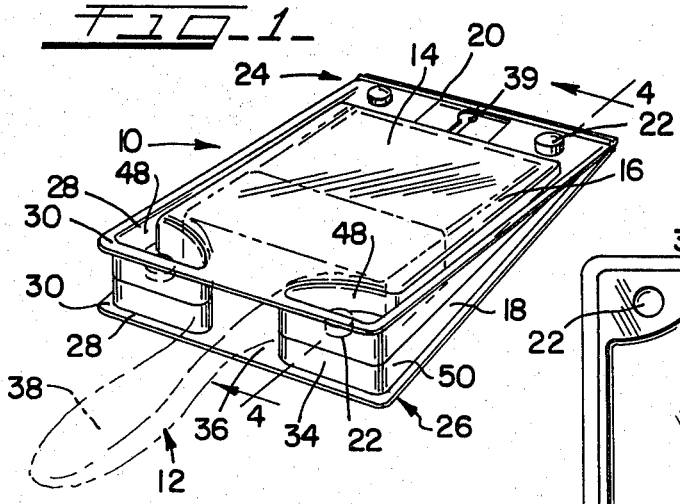
FIG. 1 is a perspective view of a molded container according to the present invention.

Referring to FIG. 1, a container 10 constructed according to the present invention releasably holds a paint brush 12 (shown in phantom) or the like within a compartment 14 formed by two panels 16 and 18 that fold along a rib portion 20 and are held together by closure means 22 located at the upper end 24 and the lower end 26 of each panel. In an alternative embodiment, closure means 22 can be provided only at the lower ends 26 of the panels.

The outer edge 28 of each panel 16 and 18 can include a continuous flange 30, the flange 30 of each panel being coplanar when the container is fully opened. Each panel also includes a recessed section 32 so that when the panels are folded together along the rib portion 20 to a closed position, the compartment 14 is formed.

In the closed position, the lower end 26 of each panel 16 and 18 combine to form a base section 34 and an opening 36 through which a portion of the article displayed within the compartment 14 can extend. In FIG. 1, for example, the handle 38 of the paint brush 12 is shown extending through the opening 36. In addition, a slot 39 in the upper end 26 of each panel combine to provide means for suspending the container from a hook or the like.

In many containers of the prior art, if a paint brush is to be held within the container, the handle of the brush must first be inserted through a pre-formed passage in the lower end of the container. For example, see the aperture 22 of Ringler (U.S. Pat. No. 2,290,359); the opening 50 of White (U.S. Pat. No. 2,506,821); the hole 3 of First (U.S. Pat. No. 2,506,954); the opening 22 of Ringler (U.S. Pat. No. 2,609,920); the opening 6 of Allen (U.S. Pat. No. 2,979,189) and the central opening 28 of Gask (U.S. Pat. No. 3,800,998).

According to the present invention, however, the container 10 is folded at the upper end 24 of each panel 16 and 18 to define the opening 36 at the lower end 26 of the container 10 for the handle of the brush. In this manner, the brush need only be placed within the recessed section 32 of one panel, and the other panel is folded over the brush 12 to close the container.

Figure 2:
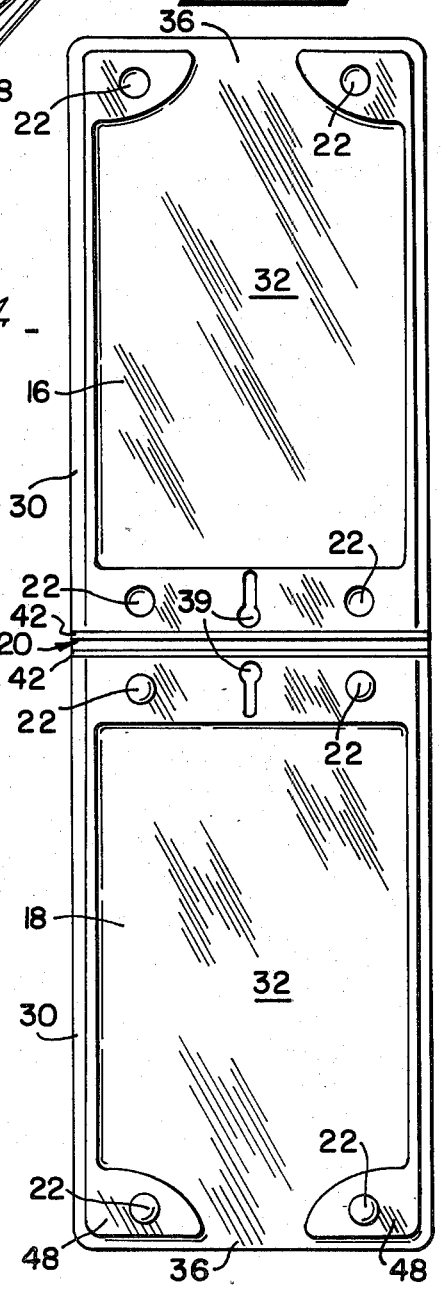
FIG. 2 is a plan view of the container in the open configuration.

In FIG. 2, the container 10 is shown in the fully opened position. Note that the panels 16 and 18 are formed so that, when the container is closed by folding the panels along the rib portion 20, the complementary portions on the inside surface 40 of each panel cooperate to releasably hold the article therebetween. In addition, the recessed section 32 of each panel is shaped to form the outline of the article that is received within the compartment 14. It will be understood, however, that the shape of the recessed section 32 can be varied within wide limits during the forming operation to accommodate almost any article.

Figure 3:
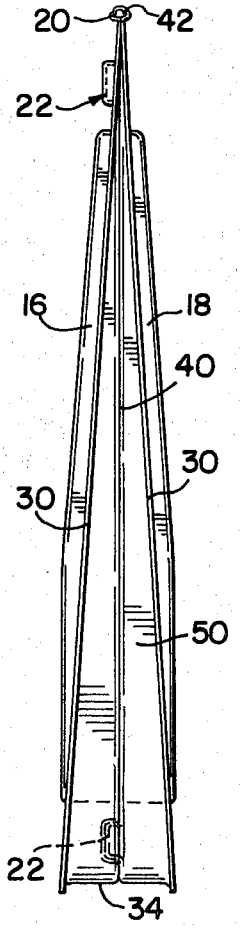
FIG. 3 is a side elevational view of the container.
Figure 4:
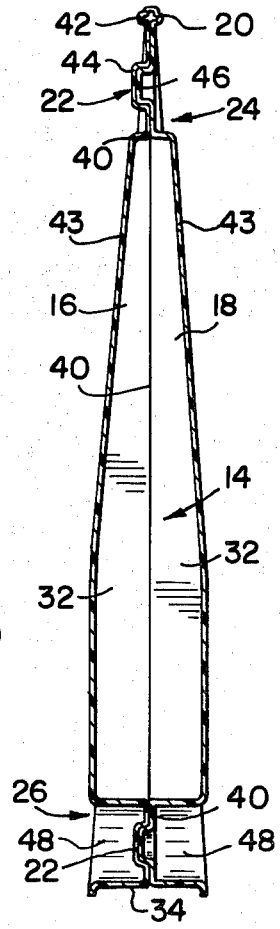
FIG. 4 is a cross-sectional view taken along the line 4—4 of FIG. 1.

FIGS. 3 and 4 show the construction of the rib portion 20, the compartment 14 and the closure means 22. In particular, the rib portion 20 comprises a series of pleats or folds 42 at the upper ends 24 of panels 16 and 18. Because a series of folds are provided, there is no single folding line that can be manipulated or creased too often to produce a tearing of the rib portion 20 and a separation of the panels. Rather, the folding action is absorbed by a series of adjacent folds that form the rib portion 20.

As shown in FIG. 4, the compartment 14 can include tapered walls 43 that maintain the brush 12 or other article in a given position. In the case of paint brushes, the condition of the bristles is very important, and use of the present invention for the storage or display of the brush prevents curling of the bristles.

As also shown in FIG. 4, the closure means 22 includes at least one first connecting member 44 in the form of a projection at the lower end 26 of the panel 16 and at least one second connecting member 46 in the form of a depression at the lower end 26 of the panel 16 whereby insertion of the first connecting member 44 within the second connecting member 46 releasably secures the panels in a closed position by a press fit to hold the article therebetween.

As illustrated in the drawings, however, a preferred embodiment of the present invention includes a pair of first connecting members 44 and a pair of second connecting members 46 located both at the upper end 24 and the lower end 26 of the panels. The connecting members 44 and 46 are preferably cylindrical and are axially symmetrical.

Moreover, each panel 16 and 18 can be formed to include a cavity 48 about each connecting member 44 and 46 at the lower end 26 of the panel so that direct pressure can be applied by the thumb and index finger of the user to releasably join the panels. It can be seen in FIGS. 1 and 4 that the cavity 48 is defined at the lower end 26 of the panel by the area between the recessed portion 32, the base section 34 and a pair of side walls 50, each side wall connecting a flange 30 and the inner surface 40 of the panel. As shown in FIG. 3, the side walls 50 in the illustrated embodiment are tapered from the upper end 26 of the panel near the rib section 20 to the base section 34. The taper and width of the side walls can, of course, be varied.

It will also be understood that various changes and modifications can be made in the above-described embodiments of this invention without departing from the spirit thereof, particularly as defined in the following claims.

That which is claimed is:

1. A molded container for displaying an article comprising first and second panels, each panel including a recess and having an upper end and a lower end, a rib portion hingably connecting the panels to one another at their upper ends so that when the panels are folded to a closed position in which the inner surface of the first panel contacts the inner surface of the second panel, a compartment is formed between said panels and a base section is defined at the lower ends of the panels including an opening through which a portion of the article displayed within the compartment can extend; and closure means including at least one first connecting member at the lower ends of the first panel and at least one second connecting member at the lower end of the second panel and gripping means comprising a recessed portion about each of said connecting members whereby insertion of said first connecting member within said second connecting member releasably secures the panels in the closed position by a press fit to hold said article therebetween, said first connecting members comprises cylindrical projections and said second connecting members comprise cylindrical depressions, said first and second connecting parts being axially symmetrical.

2. A container according to claim 1 including a flange about the perimeter of each panel, the flanges being coplanar when the panels are in a fully opened position.

3. A molded container for displaying an article comprising first and second panels, each panel including a recess and having an upper end and a lower end, a rib portion hingably connecting the panels to one another at their upper ends so that when the panels are folded to a closed position in which the inner surface of the first panel contacts the inner surface of the second panel, a compartment is formed between said panels and a base section is defined at the lower ends of the panels including an opening through which a portion of the article displayed within the compartment can extend; and closure means including a pair of first connecting members both at the upper and lower ends of said first panel and a pair of second connecting members both at the upper and lower ends of said second panel and gripping means comprising a recessed portion about each of said connecting members at the lower ends of the panels whereby insertion of said first connecting members within said second connecting members releasably secures the panels in a closed position by a press fit to hold said article therebetween, said first connecting members comprise cylindrical projections and said second connecting members comprise cylindrical depressions, said first and second connecting parts being axially symmetrical.

4. A container according to claim 3 including a flange about the perimeter of each panel, the flanges being coplanar when the panels are in a fully opened position.

* * * * *